United States Patent [19]

Bentrem

[11] 4,326,496

[45] Apr. 27, 1982

[54] FIREPLACE GRATE

[76] Inventor: George A. Bentrem, R.D. #2 - Box 154, McDonald, Pa. 15057

[21] Appl. No.: 158,041

[22] Filed: Jun. 9, 1980

[51] Int. Cl.[3] ..... F23H 13/00

[52] U.S. Cl. ..... 126/164; 126/152 B; 126/163 R

[58] Field of Search ..... 126/120, 152 B, 121, 126/152 R, 164, 165, 143, 298, 242, 163 R

[56] References Cited

U.S. PATENT DOCUMENTS 4,173,967 11/1979 Brown ..... 126/143
4,213,443 7/1980 Mayo ..... 126/143

FOREIGN PATENT DOCUMENTS 2273238 12/1975 France ..... 126/143
19534 of 1890 United Kingdom ..... 126/164
377114 7/1932 United Kingdom ..... 126/164

*Primary Examiner*—James C. Yeung
*Attorney, Agent, or Firm*—Clifford A. Poff; Thomas H. Murray

[57] ABSTRACT

A fireplace grate includes a generally air-impervious fuel support plate with an upstanding front rim. Doors slide along the outer face of the front rim to control the main flow of air to the fuel through these front rim openings. The fuel-support plate includes central slotted openings for screening ashes from the fuel and supplying draft for efficient burning at both ends of the grate. A removable cover blocks these openings when burning logs directly above to prevent a bottom draft against burning fuel, which results in less efficient burning and possible overheating of this section of the grate.

5 Claims, 4 Drawing Figures

FIREPLACE GRATE

BACKGROUND OF THE INVENTION

This invention relates to a fireplace grate having a generally air-impervious fuel support plate with, when desired, several ash-screening slots in the center and joined along the front edge with an upstanding front rim having a plurality of passageways to supply front air for combustion over the top of the fuel on the support plate through the operation of draft control members.

Some of the other fuel support grates are made up of generally parallel bars on which the fuel is supported. The fuel on the grate ignites in the presence of a bottom draft whereby the combustion process takes place under the fuel, thus causing less efficient burning, overheating of the grate, poor radiation, and pollution because the heat is directed up through the center of the fireplace to the chimney directly above the fire. The cold down draft is pulled down along the outside walls to the bottom of the fireplace before it turns in to join the center updraft.

In chimneys leading from a fire, burning in a grate, there is a continuous cycle of moving air. The hot expanded gases generated above the burning fuel move up in a column through the center of the chimney. A stream of cold, dense, heavier air is pulled down around the outside of this column to the hearth of the fireplace. This cold air cools the walls of the fireplace as it flows down to the hearth. The cold air turns in, toward the center along the hearth of the fireplace, then up through the grate to the burning fuel where it is heated and pushed up the chimney with the hot gases. Other grates are inefficient because their design contributes to this type of inefficient fireplace burning. In some grates, a 3–4 inch space exists between the outside edges of the grate and the fireplace walls. This space permits the cold down draft to go down around the outside of the grate to the hearth of the fireplace before turning up through the grate. Since the down draft drops down from all sides, the updraft is then concentrated under the center of the grate bottom where it causes the fire to burn with intense heat like a forge and the bottom of the grate will burn out.

Special grates have been proposed in the past for the support of fuel during combustion in a fireplace. One such grate is shown in U.S. Pat. No. 4,173,967 and generally comprises a flat refractory tray with rear and side edge parts movable into a sealed relation with the walls of a fireplace. Downwardly-extending flanges support the tray above the hearth and provide space for the flow of air from the bottom to an elongated enclosure in the center which rises from the top surface of the grate. The opening at the bottom of the enclosure communicates with the space below the grate. A draft control mechanism under the grate includes a valve plate with control levers to regulate the flow of air from the bottom of the tray through the draft control enclosure into the space above the tray. The front flange is solid and detachable or hinged to the tray to form an upstanding barrier so that incoming air from the room is compressed and accelerated by the venturi effect created by the angled front barrier. The flange also serves to prevent incoming air from entering the low-pressure region within the tray directly. The raised draft control structure in the center of the grate causes center burning from the bottom while the outside walls are cooled by the cold down draft on the outside walls, which will increase the flow of heat up the chimney because air is supplied through center openings in the bottom part of this structure. Moreover, accumulation of ashes and cinders on the fuel support surface of the grate will clog the air-supply openings. Ashes cannot be efficiently or adequately separated from the unburned fuel. This mixture can only be disposed of by manual removal from the top surface of the grate. The use of refractory brick to form a lining on the top surface of the plate inhibits desirable radiation of heat, from the grate, which is then lost up the chimney. The grate disclosed in this patent is designed in the same manner as a forge. The concentrated center bottom draft will cause intense heat to be generated in the center of the grate. Heat generated in this area is surrounded by cold air and is pushed up the chimney. Because of the intense heat in the center where burning occurs, rapid deterioration will occur, i.e., a burning out and warping of the draft control mechanism. Ashes and cinders can drop down to clog the draft opening and the movable control plate under the bottom. The extension of the draft control housing up into the body of the grate would interfere with the arrangement and stoking of fuel in the grate. Center bottom burning will waste heat and cause excessive smoking. The cold down draft would be allowed to cool down the fireplace walls and push the heat toward the center of the grate.

To obviate the foregoing disadvantages of known forms structure for accommodating the combustion of fuel in a fireplace, the present invention provides an improved construction and relationship of parts to not only reduce the escape of heat through the chimney but also insure a safe, more efficient controlled burning of fuel. The fuel is burned at each end of the grate over a solid bottom by draft supplied from the front through openings at each end of the front rim and controlled by sliding doors. The slotted center section of the grate, when open, is kept free of fuel. An upward flow of air through this section spreads the flames over the top of the fuel toward the walls of the fireplace. The fire burns up along the sides, back and inside of the front rim, all of which radiate heat to the room.

The present invention is designed to radiate heat into the room like a stove, produce less smoke while burning in a controlled, fuel-saving manner. The design offers particularly significant advantage for a 24-hour burning period with only one filling of coal but somewhat less when wood logs are used. The grate of the present invention is designed for burning of fuel just inside of a front rim, along both sides and along the back of the fireplace. The walls of the fireplace as well as the front rim are heated and more efficiently radiate heat to the room. The cold down draft cannot fall below the burning site because the cooler air turns in over the fuel burning site from where it is heated and pushed up the chimney. The flow of air over the top of the fuel supports efficient top burning. There is no burning from the bottom so the grate does not overheat and firebrick is not necessary. The bottom is solid except for several slots, e.g., approximately ½ inch wide in the center, which extend from front to rear, to allow finely-burned ashes to drop to the hearth of the fireplace. This occurs when the remaining partially-burned fuel is moved over the slotted area before restoking. The new fuel is added to the end-burning area. The partially-burned fuel is then shoveled back over the top of the new fuel to burn from the top down. The center slotted area is kept open to supply needed draft up over the fuel. Some air flows over the top of the front rim from the room which also helps to support combustion over the top of the fuel. Draft control doors slide on tracks on the outside of the front rim and are located at each end. There is a special draft door in the center. These doors supply the necessary draft needed to control the fire. Air entering at the ends of the grate supports burning at each end next to the walls. The fire is started just back of and above the end doors. When burning logs lengthwise, a small removable plate may be placed over the slotted area to prevent inefficient center burning. If the logs are cut shorter and do not extend over the slotted area, the removable cover plate is not necessary.

SUMMARY OF THE INVENTION

It is an object of the present invention to provide an improved fireplace grate having a generally solid bottom plate joined in an airtight manner with an upstanding frontal rim and having draft-control means operatively associated with openings in the frontal rim to vary the supply of air directly onto the fuel from the front at the burning site.

It is still another object of the present invention to provide an improved construction and relationship of parts for a fireplace grate to insure safe, controlled and more efficient combustion of fuel for both the propagation and radiation of heat from a fireplace into the room of the dwelling with less escape of heat and air pollution in a chimney. Combustion at the ends of the grate heats the front, sides and back of the fireplace.

It is a still further object of the present invention to provide an improved fireplace grate having versatility an ease of operation. The design of this grate eliminates the need for parts under the grate that are subject to warping, clogging or jamming incident to their necessary movement for controlling the supply of air for combustion or interference with the removal of ashes.

It is still another object of the present invention to provide an improved fireplace grate that is readily useful for combustion of coal or wood as the fuel in a fireplace within a dwelling. It can be used continuously, for months at a time, with trouble-free performance.

More specifically, according to the present invention there is provided a fireplace grate comprising a generally air-impervious fuel support plate adapted to extend laterally between the side walls of a fireplace, an upstanding rim coupled in a generally airtight manner along the front edge of the fuel-support plate for retaining fuel on the top surface of the plate. The front rim has a plurality of passageways to supply air from the front toward the fuel while carried on the support plate, and draft-control means supported thereby to control the flow of air for combustion along the top surface of the fuel at the outside ends of the grate. Support means, such as andirons, maintain the fuel-support plate at a spaced relation above the hearth of a fireplace.

In the preferred aspect of the present invention, the fuel-support plate includes small openings in the center of the plate for the passage of ashes from the top surface of the plate to the space therebelow. The openings define a relatively small area, which is kept open and free of fuel. Burning takes place at the end of the grate between the openings and the end of the grate. The supply of air through these openings to the space above the plate directs burning over the top of the fuel and outward toward the sides, back and front. Burning over the top surface of the fuel accounts for more efficient combustion, less pollution and economical use of fuel. Effective control of front air supplied to the burning site is by the draft-control means on the front rim. A removable cover plate is placed over the openings in the fuel support plate before wood logs are burned. Preferably, the front rim has a plurality of passageways for supplying air in a direction toward the fuel. There are several unique advantages of having the draft supplied from the front ends rather than the bottom, the fire burns up and back over the top surface of the fuel to burn the smoke, the fire is easier to manage, more heat is directed to the front, sides and back of the fireplace, and the grate does not overheat. The draft-control means include variably positionable door members supported by the front plate for each opening therein. The openings are spaced toward opposite ends of the front rim, each having a vertical fuel retention strap. The draft-control means preferably include doors that are slideably supported by the front rim for each opening. Such support for the door preferably includes bars attached by stand-off spacers to the rim so that slots exist within which a door member can slide relative to the opening used to feed air toward the fuel from the front.

These features and advantages of the present invention as well as others will be more fully understood when the following description of the preferred embodiment of the present invention is read in light of the accompanying drawings, in which.

Figure 1:
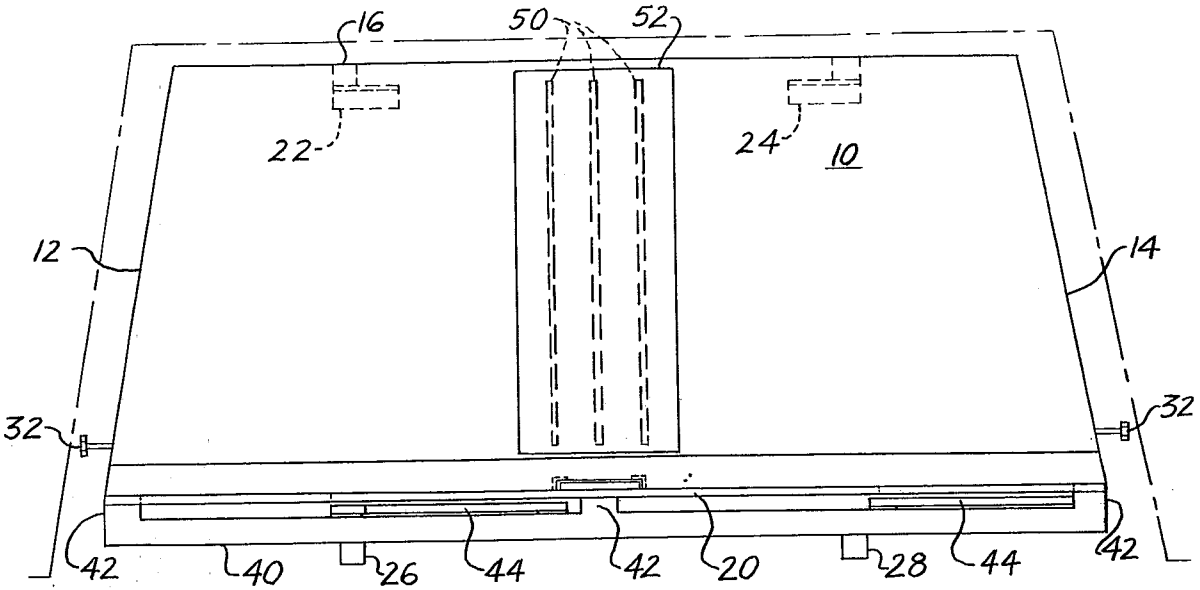
FIG. 1 is a plan view of a fireplace grate embodying the features of the present invention.
Figure 2:
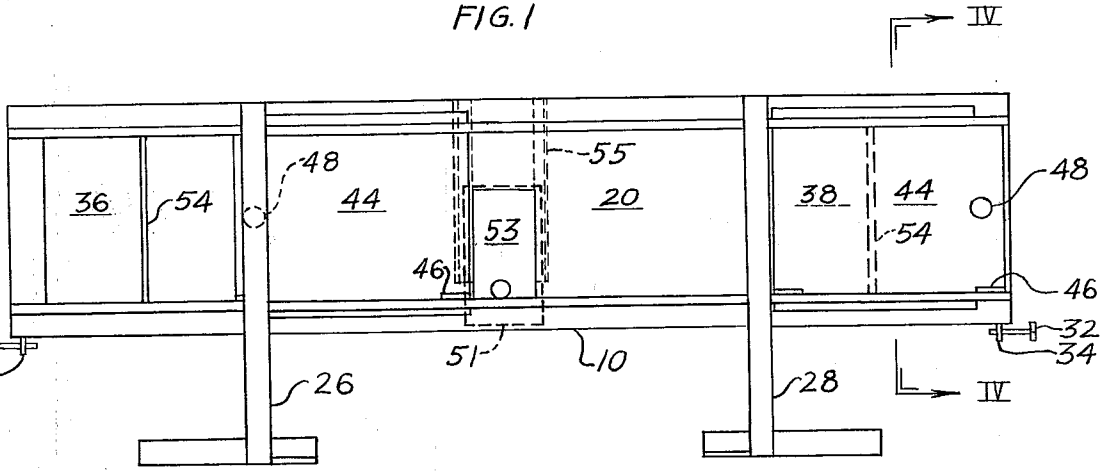
FIG. 2 is a front elevational view of the grate shown in FIG. 1.
Figure 3:
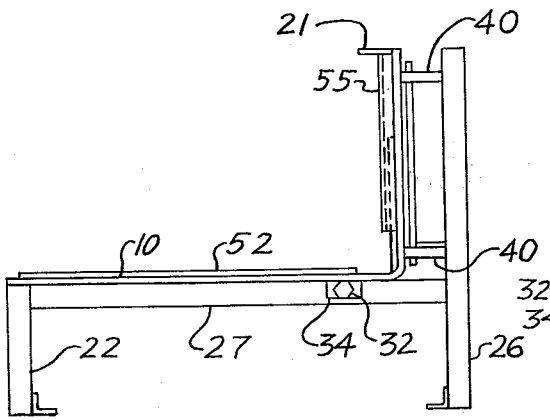
FIG. 3 is a side elevational view of the grate shown in FIGS. 1 and 2.
Figure 4:
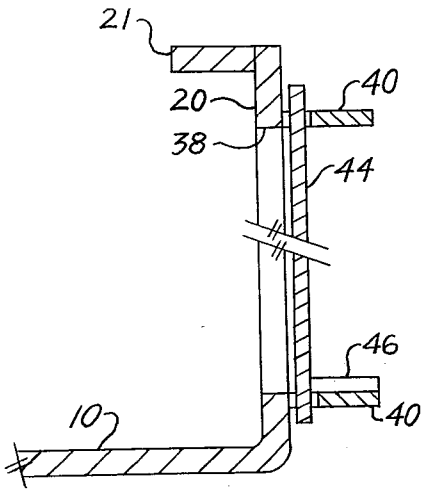
FIG. 4 is an enlarged sectional view taken along line IV—IV of FIG. 2.

As shown in FIGS. 1–3 of the drawings, the fireplace grate includes a generally solid fuel-support plate 10 having a profile defined by side edges 12 and 14 as well as a back edge 16 to conform to the general configuration of a fireplace in a domestic dwelling. Essentially, this profile is of the same shape as the fireplace hearth, whereby the side edges 12 and 14 reduce the width of the plate toward the rear edge 16 while the front of rim 20 defines an edge with the greatest length. The plate 10 is generally made of metal, such as steel, and is joined either as an integral part or an attachment to the front rim 20. The front rim may be a separate plate member that is welded along its bottom edge to the front edge of the fuel-support plate 10. It is preferred, however, to form the front rim as an integral part of the fuel-support plate by a bending process such that the rim extends at an angle of approximately 90° to the fuel-support plate as shown in FIG. 4. When desired, a flange 21 is added to the rim along its top edge for added strength.

Any of the usual well-known forms of andirons may be used to support the grate of the present invention within a fireplace. Andirons or other forms of support similar to those shown include grate-engaging bars 27 carried above the hearth by legs 22, 24, 26 and 28. The desired center position of the grate between the side walls of a fireplace, shown by phantom lines in FIG. 1, can be maintained by adjustment members 32 threaded into nuts 34 which are attached to the bottom surface of the plate 10 at each side.

The front rim 20 has air-supply openings 36 and 38 at its opposite lateral sides. Each opening has an area slightly less than about one-fourth of the area of the front rim. A fuel-retention strap 54 prevents fuel spillage through the openings. Along the bottom edge and top edge of the rim, above and below the openings 36 and 38, there extends lateral support bars 40 that include spacers or stand-off sections 42 by which the bars are supported at a spaced-apart relation from the rim. The spaces between the stand-off members 42 at each end half of the rim form slide channels for supporting a door member 44. Each door member is removable and is essentially a flat plate that includes ribs 46 projecting from the lower portion to engage the lower bar 40 for support. Holes 48 are used to position the doors along the rim for the selective control of the supply of air through the front openings in the rim to the burning site of the fuel on the plate 10. The doors are inserted and removed from their supporting relation on the front rim by lifting the doors so that their lower edges rise within the slot formed by bars 40 above the lower bar. The lower edge of the door is then tilted outwardly away from the rim so that it can be lowered to remove the top portion from confining engagement in the slot formed by top bar 40.

To faciliate ash removal, the plate 10 has parallel, spaced-apart openings 50 (FIG. 1) extending from about 1 inch from the front edge rearwardly toward the rear edge to a point about 1 inch from the rear edge. These openings are relatively narrow, usually about one-half inch wide to permit screening of ashes from the top surface of the plate 10 onto the hearth below. The openings are kept open and free of fuel and provide a small supply of air that is particularly useful for aiding combustion over the top surface of the fuel at both ends of the grate. When partially-burned fuel is moved over the openings, ashes carried along with the fuel are screened from the fuel so that only unburnt pieces of fuel remain on the plate. This conserves fuel. A small amount of air will pass from the space beneath the plate 10 around the side edges of the plate. The flow of air in this manner facilitates the burning of fuel toward the outside edge of the plate where it heats the fireplace walls. In addition to doors 44, preferably a door 51 is moved to control draft through a center opening 53 in the rim 20, held in position by side support angles 55.

Experimental tests have shown that a fireplace grate embodying the construction of parts as described above provides a surprising effective combustion control through the use of the doors located on the front rim. When these doors are closed, all front draft that controls the rate of combustion is blocked from the burning site. A supply of air passes over the top of the front rim to aid combustion over the top surface of the fuel to burn smoke. It has been found that air flows in an effective and controlled manner through the openings in the front rim directly to the burning site because of the close proximity of the fuel to the openings. The fire burns up in front and then spreads back over the top of the fuel for more efficient burning. As the burning process proceeds, the front rim forms a very effective element to radiate heat into the room of the dwelling. It has also been found that the slotted area in the plate is not only useful for screening fine material from burnt ashes, but tests have also shown that since vigorous combustion occurs over any opening in the bottom when supplied by the bottom draft, that it is desirable to keep the slotted section open and free of fuel. Air through these openings is very important to aid in efficient combustion over the top surface of the fuel at both ends of the grate. Coal and short logs are burned between the center openings and the end of the grate over the solid bottom area where the front draft control doors provide effective control of the burning process. When logs are burned over the slotted openings in the center of the bottom plate, the openings are covered by a cover plate 52 to close these openings which will block all bottom draft to the burning site.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A fireplace grate comprising a generally air-impervious fuel-support plate extending to side walls of a fireplace, an upstanding front rim joined in an essentially airtight manner with a front edge of said fuel-support plate for retaining fuel on the top surface of the fuel-support plate, said upstanding front rim being air-impervious to normally block a flow of air from the fuel combustion site while permitting a supply of air to pass into the fireplace over the top of the front rim to aid combustion over the top surface of the fire for burning smoke, said upstanding front rim having at least one air passageway at a lateral side thereof to supply air from the front toward the fuel-burning site on said fuel-support plate, draft control means supported by said upstanding front rim to control the flow of air in said passageway below the top of the front rim to the burning site of fuel on said fuel-support plate, and leg means extending to the hearth of a fireplace for maintaining said fuel-support plate at a spaced location above the hearth.

2. The fireplace grate according to claim 1 wherein said fuel-support plate is solid except for openings in the center for the passage of ashes from the top surface of the plate to the space therebelow, and a removable cover for said opening in the fuel-support plate.

3. The fireplace grate according to claim 1 wherein said upstanding front rim has an air passageway at each of opposite lateral sides thereof for supplying front air in a direction toward the fuel, and wherein said draft control means includes a variably positionable member supported by said upstanding front rim for each air passageway therein.

4. The fireplace grate according to claim 3 wherein said variably positionable member for each air passageway includes a door slideably supported by said upstanding front rim.

5. The fireplace grate according to claim 4 further including upper and lower support bars spaced outwardly from said upstanding front rim to slideably carry said door member for each air passageway.

* * * * *